United States Patent [19]

Brandt

[11] Patent Number: 4,697,648

[45] Date of Patent: Oct. 6, 1987

[54] SPRING-LOADED SUSPENSION SYSTEM FOR AUGERS AND SCREW ANCHORS

[76] Inventor: Bernd A. Brandt, 108 Sylvan Avenue, Scarborough, Ontario, Canada, M1M 1K3

[21] Appl. No.: 782,918

[22] Filed: Sep. 24, 1985

[51] Int. Cl.[4] ..... E21B 17/07

[52] U.S. Cl. ..... 173/162 R; 173/28

[58] Field of Search ..... 173/22, 28, 139, 141, 173/162 R; 175/162, 202, 203, 321

[56] References Cited

U.S. PATENT DOCUMENTS

| | | | |
|---|---|---|---|
| 1,785,559 | 12/1930 | Ponti . | |
| 1,862,629 | 6/1932 | Morrison . | |
| 3,307,643 | 3/1967 | Ferri . | |
| 3,452,829 | 7/1969 | Smith | 173/28 |
| 4,186,569 | 2/1979 | Aumann . | |
| 4,371,041 | 2/1983 | Becker et al. | 173/28 |
| 4,398,898 | 8/1983 | Odom | 175/321 X |
| 4,552,230 | 11/1985 | Anderson et al. | 175/321 |

*Primary Examiner*—E. R. Kazenske
*Assistant Examiner*—James L. Wolfe
*Attorney, Agent, or Firm*—Ridout & Maybee

[57] ABSTRACT

A spring-loaded suspension system for a power-driven auger or screw anchor suspended from the boom of a digger derrick includes a cushing device to cushion shock loads and vibration. The system is articulately connected to the boom by a linkage which provides a universal pivotal connection between the power drive and the boom. In one embodiment of the invention the linkage is a spring-loaded telescopic link. In an alternative embodiment of the invention a torque-transmitting coupling between the output shaft of the power drive and the auger or screw anchor is itself a spring-loaded telescopic link.

4 Claims, 5 Drawing Figures

SPRING-LOADED SUSPENSION SYSTEM FOR AUGERS AND SCREW ANCHORS

This invention relates to a spring-loaded suspension system for a derrick-mounted rotary boring tool, such as an auger, a screw anchor, or like tool to be driven into the ground. The tool is usually suspended from the derrick boom by a composite shaft assembly including powder drive means for the tool and a drive shaft for transmitting torque from the drive means to the tool. The shaft assembly is articulately connected to the boom by a linkage.

The installation of a screw anchor or an auger on the boom of a digger derrick is a skilled operation which must be carried out with considerable care in order to ensure that the various boom functions will be coordinated with the movement of the screw anchor or auger as it enters the ground, particularly if it will be driven at an angle to the boom. In the past, especially under adverse conditions, imperfect installation has resulted in damage to the boom and to the drive gear, or improper entry of the screw anchor into the ground, reducing its holding power.

In order to overcome the problems experienced in the past with such equipment, the present invention provides a spring-loaded suspension system for the tool incorporating means to cushion shock loads transmitted from the tool to the boom while minimizing strain on the boom caused by imperfect coordination between movements of the boom and travel of the tool.

According to one aspect of the present invention, a composite suspension system for a rotary boring tool, such as an auger or a screw anchor to be driven into the ground, the tool being suspended from a derrick boom by a composite shaft assembly including power drive means for the tool and articulately connected to the boom by linkage means, is characterized in that one component of the shaft assembly is a telescopic link formed by an outer tubular member, a piston member slidably and non-rotatably mounted within the tubular member, and opposed compression springs acting on opposite sides of the piston member thereby to cushion telescopic extension and contraction of the link.

According to another aspect of the invention there is provided in a spring-loaded suspension system for a rotary boring tool to be driven into the ground, the tool being suspended from a derrick boom comprising a drive assembly having a stationary casing housing a motor and having a rotary output shaft extending from the casing, coupling means for coupling the tool to the output shaft coaxially therewith so as to be driven thereby, and linkage means articulately interconnecting the casing of the drive assembly with the boom, said linkage means providing a pair of pivots having mutually perpendicular axes defining a universal pivotal connection between the casing and the boom.

Two embodiments of the invention will now be described, by way of example, with reference to the accompanying drawings, in which.

Figure 1:
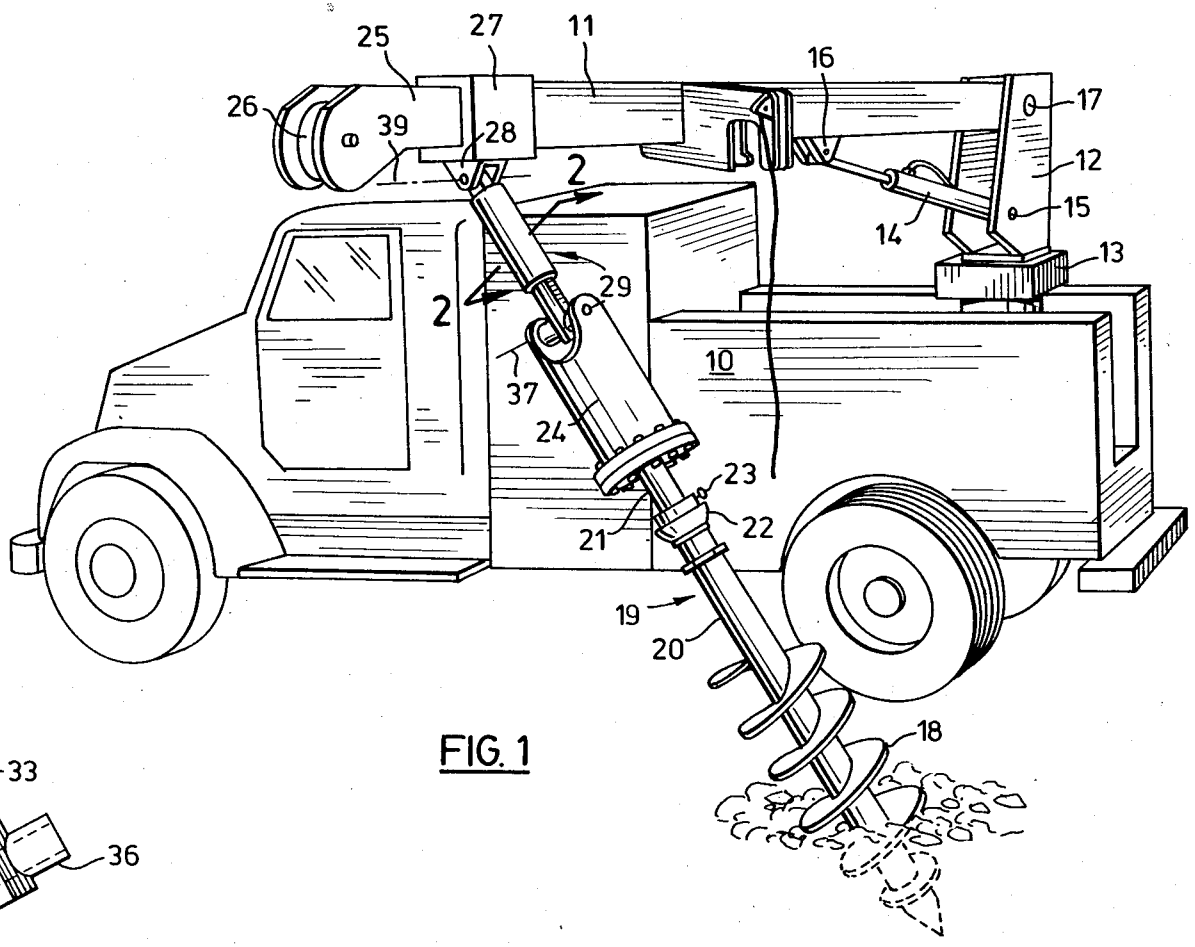
FIG. 1 shows a digger derrick having a built-in spring-loaded suspension system in accordance with the present invention for suspending an auger from the derrick boom.

Referring to FIG. 1, the digger derrick is represented by a vehicle 10 carrying a boom 11 which extends generally horizontally. The vehicle 10 is normally provided with an outrigger (not shown) having extensible feet, for the purpose of stabilizing the vehicle in a digging operation. At its inner end the boom 11 is pivotally mounted in a bracket 12 for pivotal movement about a horizontal axis, and the bracket 12 is mounted on a rotary pedestal 13 for rotating the radially extending boom about a vertical axis. A hydraulic ram 14 pivotally connected to the bracket 12 by a pivot 15 extends to a bracket 16 on the underside of the boom 11, to which it is pivotally connected. The ram is operable to raise and lower the boom about the horizontal boom pivot 17.

A rotary boring tool 18 is suspended from the boom 11 by spring-loaded suspension system generally indicated at 19. In the present example the tool 18 is shown as an auger, but the equipment shown could alternatively be used to install a screw anchor in the ground, in which case the auger would be replaced by the screw anchor.

The auger 18 is of a conventional type having a hollow shaft 20 adapted to receive a Kelly bar 21. The Kelly bar 21 extends into the shaft 20 and is keyed to it by means of a collar 22 on the shaft, which collar has a hexagonal socket receiving the Kelly bar for transmitting torque therefrom to the auger. The collar 22 is locked to the Kelly bar by a bolt 23.

The suspension system 19 includes a drive assembly comprising a hydraulic motor and gearing housed in a casing 24. The Kelly bar 21 is coupled to the motor so as to be driven by it and constitutes the rotary output shaft of the drive assembly. The drive assembly itself is a well known commercial item and need not be described in detail herein.

The boom 11 comprises a hollow beam in which a boom extension 25 extends telescopically. In the stowed position the boom extension 25 is fully retracted into the boom but for the operation of the digger can be extended radially. A winch 26 is provided at the end of the boom extension.

On the boom extension 25 is a shadow box 27, carrying a bracket 28 on its underside. The composite shaft assembly forming the suspension system 19 is articulately connected to the boom extension by means of a spring-loaded telescopic link 29 pivotally connected at its ends to the bracket 28 and the casing 24 of the drive assembly respectively. The telescopic link 29 is shown in detail in FIG. 2. The link is formed by an outer tubular member, or cylinder 30, in which a piston member 31 is slidably and non-rotatably mounted. The piston member 31 comprises a piston head 32 with a piston rod 33 of hexagonal cross section extending from it. The ends of the cylinder 30 are closed by end plugs 34, 35, which are welded, bolted or otherwise secured in place, the lower end plug providing a hexagonal aperture or socket through which the piston rod 33 extends thereby to prevent rotation of the piston within the cylinder. The lower end of the piston rod 33 is fitted with a pair of opposed stub shafts 36 for receiving a pivot by which the piston member is pivotally connected to the casing 24 of the drive assembly for pivotal movement about an axis 37 (FIG. 1) perpendicular to the axis of the output shaft 21. A connector block 38 welded to the upper end plug 34 is apertured to receive a pivot pin by which the cylinder is pivotally connected to the bracket 28 (FIG. 1) for pivotal movement about an axis 39. The pivotal axes 37 and 39 are perpendicular to the drive axis of the auger and are mutually perpendicular to one another, thereby defining a universal pivotal connection between the casing of the drive assembly in the boom.

A pair of opposed compression springs 40, 41 housed in the cylinder 30 act on opposite sides of the piston head 32 and thus serve to absorb shock loads transmitted from the auger by cushioning telescopic extension and contraction movements of the telescopic link.

Figure 2:
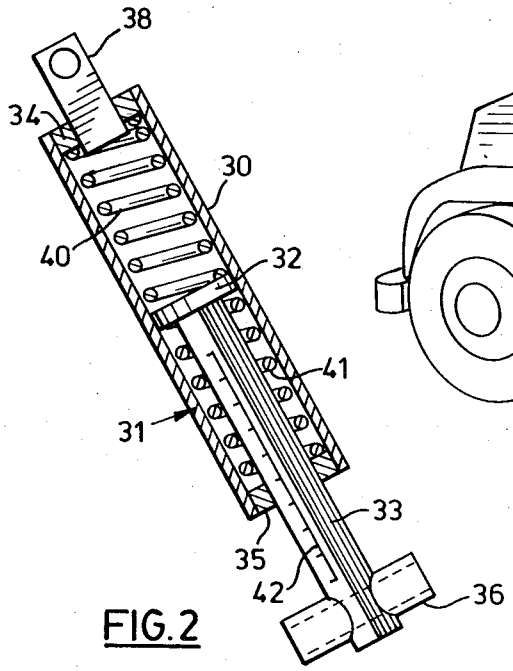
FIG. 2 is a longitudinal section, taken on line 2—2 in FIG. 1, of a telescopic link forming part of the suspension system.

The visible length of the piston rod 33 provides a visual indication of auger travel, and for this purpose the piston rod may bear marking 42 as shown in FIG. 2.

Figure 3:
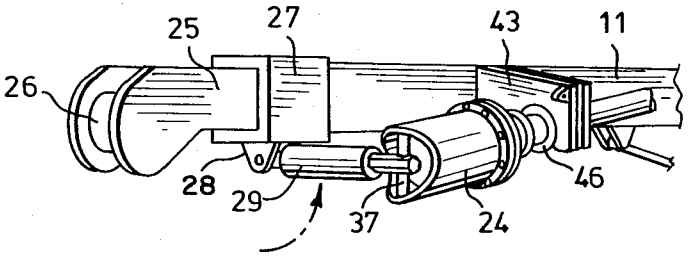
FIG. 3 shows a detail of the suspension system mounted on the boom in the stowed position.

Referring now to FIG. 3, a bracket 43 projects laterally from the boom 11, the bracket providing a notch having a bottom opening which receives the Kelly bar 21 when the suspension system 18 is stowed alongside the boom as shown in FIG. 3. The system is retained in the stowed position by means of a hydraulic latch 44 (FIG. 1). In this position the boom extension 25 is fully retracted within the boom 11. In order to release the suspension system to the operative position shown in FIG. 1, the hydraulic latch 44 is opened to release the suspension system which descends under its own weight. A suspension cable 45, which is normally wound on a drum 46 on the auger shaft and retained by a hook on the drum, unwinds as the suspension system descends. The cable 45 is then released from the hook and the boom can be extended as necessary to bring the auger to the required position. In order to return the system to the stowed position, the cable 45 is again threaded onto the hook on the drum 46, after retracting the boom extension, and is wound onto it simply by rotating the auger.

Figure 4:
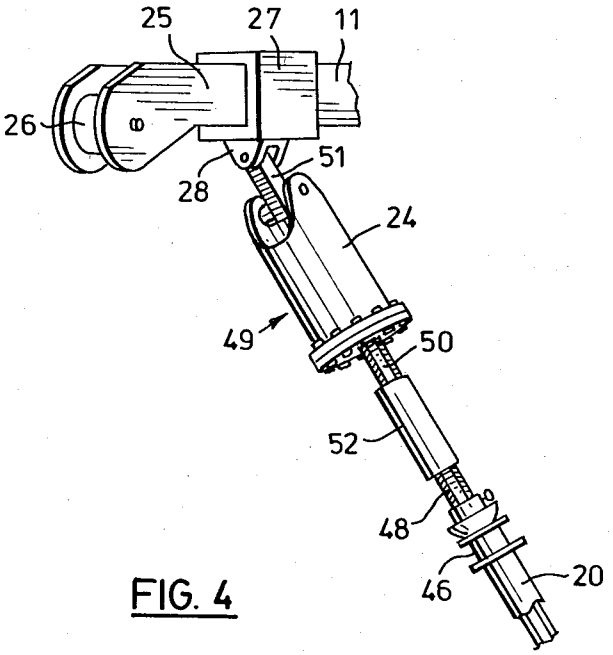
FIG. 4 shows a detail of a modified suspension system in accordance with the invention.

A modified suspension system is illustrated in FIG. 4. As in the preceding embodiment illustrated in FIGS. 1 to 3, the suspension system is a composite shaft assembly suspended from a derrick boom 11, the boom having a telescopic extension 25 carrying a winch 26 at its end. A shadow box 27 on the extension 25 provides a bracket 28 on its underside to which the system is articulately connected.

Figure 5:
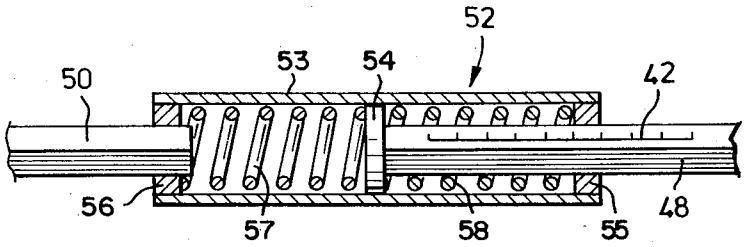
FIG. 5 shows a detail of the telescopic link shown in FIG. 4.

In FIG. 4 the rotary boring tool is an auger having a hollow shaft 20 into which a Kelly bar 48 extends, the Kelly bar being keyed to the shaft by a collar 22 providing a hexagonal socket as previously described. The drive assembly 49 is also as previously described with reference to FIG. 1; it comprises a stationary casing 24 housing a hydraulic motor and gearing driving a hexagonal output shaft 50. However, there are two important differences between this embodiment and the previous embodiment. First, the drive assembly casing is articulately connected to the bracket 28 by a rigid link 51. The rigid link 51 is pivoted at its ends to the casing 24 and the bracket 28 for pivotal movement about respective pivotal axes 37, 39 which are perpendicular to one another and to the drive axis of the system, thus providing a universal pivotal connection between the suspension system and the boom. Second, the output shaft 50 of the drive assembly and the Kelly bar 48 are coupled together by a torque-transmitting device 52 constituted by a telescopic link. As shown in FIG. 5, the telescopic link 52 is formed by an outer tubular member 53 and a piston member 54, the Kelly bar 48 acting as a piston rod extending from the piston head and being constrained by an end plug 55 having a hexagonal socket through which the Kelly bar extends so as to prevent rotation of the piston within the tubular member while permitting sliding of the piston member. At the other end of the tubular member 53 is an end plug 56 providing a hexagonal socket into which the output shaft 50 is welded. As in the preceding embodiment of the invention, a pair of opposed compression springs 57, 58 act on opposite sides of the head of the piston member 54, thereby to cushion telescopic extension and retraction of the link.

What I claim is:

1. A spring-loaded suspension system for a rotary boring tool to be driven into the ground, the tool being suspended from a derrick boom, comprising a drive assembly having a stationary casing housing a motor and having a rotary output shaft extending from the casing, coupling means for coupling the tool to the output shaft coaxially therewith so as to be driven thereby, and linkage means articulately interconnecting the casing of the drive assembly with the boom, said linkage means providing a pair of pivots having mutually perpendicular axes defining a universal pivotal connection between the casing and the boom, said linkage means comprising a telescopic link formed by an outer tubular member, a piston member slidably and non-rotatably mounted within the tubular member, and opposed compression springs acting on opposite sides of the piston member thereby to cushion telescopic extension and contraction of the link, said members being pivotally connected by said pivots to the derrick boom and to the casing of the drive assembly respectively, for pivotal movement about said mutually perpendicular axes.

2. A spring-loaded suspension system according to claim 1, wherein the rotary boring tool is a screw anchor.

3. A spring-loaded suspension system according to claim 1, wherein the rotary boring tool is an auger having a hollow shaft adapted to receive said output shaft of the drive assembly and means for keying the auger shaft to the output shaft to rotate therewith.

4. A spring-loaded suspension system according to claim 3, wherein the piston member has a piston rod projecting from one end of the tubular member, the piston rod bearing markings providing a visual indication of auger travel.

* * * * *